US007537492B2

(12) United States Patent
Fekonia et al.

(10) Patent No.: US 7,537,492 B2
(45) Date of Patent: May 26, 2009

(54) PLUG-TYPE CONNECTOR WITH SLEEVE-TYPE PLUG AND SOCKET

(75) Inventors: Rudolf Fekonia, München (DE); Arnold Federer, Götzia (AT); Kurt Ellensohn, Götzia (AT); Dagmar Dirnbauer, Braz (AT)

(73) Assignee: Hirschmann Automotive GmbH, Munich (DE)

( * ) Notice: Subject to any disclaimer, the term of this patent is extended or adjusted under 35 U.S.C. 154(b) by 0 days.

(21) Appl. No.: 12/004,089

(22) Filed: Dec. 19, 2007

(65) Prior Publication Data

US 2008/0220640 A1 Sep. 11, 2008

(30) Foreign Application Priority Data

Dec. 20, 2006 (DE) ..... 10 2006 060 238

(51) Int. Cl.
*H01R 13/502* (2006.01)

(52) U.S. Cl. ..... 439/701

(58) Field of Classification Search ..... 439/701, 439/686, 695

See application file for complete search history.

(56) References Cited

U.S. PATENT DOCUMENTS

| | | | | |
|---|---|---|---|---|
| 4,946,398 | A * | 8/1990 | Takenouchi et al. | 439/599 |
| 5,685,743 | A * | 11/1997 | Schmidt et al. | 439/701 |
| 5,788,522 | A * | 8/1998 | Kameyama | 439/248 |
| 6,152,768 | A * | 11/2000 | Beugnot et al. | 439/595 |
| 6,261,116 | B1 * | 7/2001 | Ceru | 439/352 |
| 6,530,799 | B2 * | 3/2003 | Regnier et al. | 439/352 |
| 6,669,510 | B2 * | 12/2003 | Yamawaki et al. | 439/595 |
| 6,773,309 | B1 * | 8/2004 | Shuey | 439/701 |
| 7,232,323 | B2 * | 6/2007 | Mohs et al. | 439/265 |
| 2002/0081888 | A1 * | 6/2002 | Regnier et al. | 439/352 |
| 2007/0049088 | A1 * | 3/2007 | Mohs et al. | 439/265 |

* cited by examiner

*Primary Examiner*—Gary F. Paumen
(74) *Attorney, Agent, or Firm*—Andrew Wilford

(57) ABSTRACT

A plug-type connector has a plug-type socket, a contact holder fittable in the plug-type socket, and a cover shell engaged around the contact holder and fittable with the plug-type socket. Latch formations on the cover shell and on the contact holder secure the holder and shell together in a prelatched position with the holder only partially fitted in the shell. Thus, when the holder is fitted in the socket, the shell is to the socket and the holder is shifted in the shell into a final position fully inserted in the shell.

8 Claims, 7 Drawing Sheets

PLUG-TYPE CONNECTOR WITH SLEEVE-TYPE PLUG AND SOCKET

FIELD OF THE INVENTION

The present invention relates to a plug-type electrical connector. More particularly this invention concerns such a connector having a plug-type socket and a fitting engageable therewith having a contact holder and a cover shell.

BACKGROUND OF THE INVENTION

Such a plug-type connector that a socket-type plug and a fitting (also called a coupling, jack or box) are generally known from the prior art. The plug and fitting are plugged into each other to bring the contacts located in the plug and in the fitting into active connection and establish an electrical connection. In particular when such a plug-type connector is used in an automotive vehicle, it is not enough simply to plug together the plug and fitting. Because of the stresses on the plug-type connectors in operation within the vehicle and in assembly, it is necessary to establish a durable, but if necessary detachable, connection between the plug and fitting and at the same time to ensure in the assembly, i.e. the plugging together of the plug and fitting, that the plug and fitting are in their desired positions with respect to one another (completely plugged together).

For this purpose, it has become known from the prior art to design the fitting with a contact holder for holding the contacts that are positioned at the end of a cable and to provide the fitting with a cover shell (also called housing), with the completely assembled fitting being then fitted to the socket-type plug. These parts have corresponding latch formations that hold the plug and fitting effectively and durably in connection with one another after they are plugged together.

This structure basically meets requirements, but it has disadvantages in assembly. Ordinarily, fabrication of the fitting occurs in a different facility than assembly of the fitting with the plug. For that reason, it must be ensured that the fabricator who manufactures the fitting also provides the contacts and the cable. These parts can be manufactured reliably in one place, while the assembly of the fitting and the plug is done else where, normally by the vehicle manufacturer.

OBJECTS OF THE INVENTION

It is therefore an object of the present invention to provide an improved plug-type connector with sleeve-type plug and socket.

Another object is the provision of such an improved plug-type connector with sleeve-type plug and socket that overcomes the above-given disadvantages, in particular that meets standard requirement while being easy to make and simple to assembly and disassemble.

SUMMARY OF THE INVENTION

A plug-type connector has according to the invention a plug-type socket, a contact holder fittable in the plug-type socket, and a cover shell engaged around the contact holder and fittable with the plug-type socket. Latch formations on the cover shell and on the contact holder secure the holder and shell together in a prelatched position with the holder only partially fitted in the shell. Thus, when the holder is fitted in the socket, the shell is to the socket and the holder is shifted in the shell into a final position fully inserted in the shell.

Thus according to the invention the cover shell and the contact holder of the fitting and a socket of the plug have latch formations that can be brought into active connection with one another in such a way that the cover shell is first brought into a prelatched position with the contact holder, and the contact holder is plugged into the socket thereafter. The cover shell is then slid in the direction of the socket after complete plugging and being latched there in a final position by lock formations.

This structure has the advantage that the contact holder, which has seats for the respective contacts, can be manufactured and fitted with the contacts by the manufacturer and fabricator of the plug-type connector. Thereafter, the cover shell is plugged into or slid onto the contact holder, so that they assume the stable prelatched position. Alternatively, the cover shell is fitted on the contact holder in the prelatched position and the contacts are fitted only thereafter at a different company, the so-called fabricator. Meanwhile, the latch formations that are responsible for this prelatched position are designed so that the cover shell remains in a prelatched position on the contact holder, but can be slid into its final latch position only after the contact holder has been completely plugged together with the socket of the plug.

This provides the advantage that the fitting with its contact holder and cover shell can be manufactured and fabricated in another facility, and the further assembly can be done in another facility. In addition, the advantage is provided that the cover shell is positioned on the contact holder in a loss-proof manner. Furthermore, the advantage is provided that the plug can be manufactured and likewise fabricated independently from the fitting. After this fabrication, the plug and fitting can then be assembled and plugged together in another facility, in particular by the automobile manufacturer, with the inventive latch formations having the further advantage that they are designed in such a way that the cover shell can be brought out of its prelatched position into a final latch position on the plug only after the contact holder has been completely plugged together with the plug. Furthermore, additional lock formations are present that cause the cover shell to be solidly latched to the plug after the cover shell too has been brought into its final latched position. As the above, this is possible only after the contact holder and plug have been plugged together in their intended position. This is important so that the contact can become effective between the contacts in the plug and in the fitting.

A further advantage of the latching connection between the cover shell and the contact holder is attributable to the fact that, by movement of the cover shell from its prelatched position on the contact holder to a final latch position, correspondingly designed contacts can also be actuated. This is important in particular if a so-called zero-force plug-type connector is to be achieved. This means that the contacts can be fitted over the contacts of the plug nearly force-free and the required contact force is applied to the contacts manually from the outside only after the cover shell is actuated from its prelatched position into its final latch position. This facilitates in particular the plugging together of plug and fitting, so that the ease of assembly is improved due to lower forces to be applied. In this way, higher contact normal forces can also be attained than with conventional plug-in connectors.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
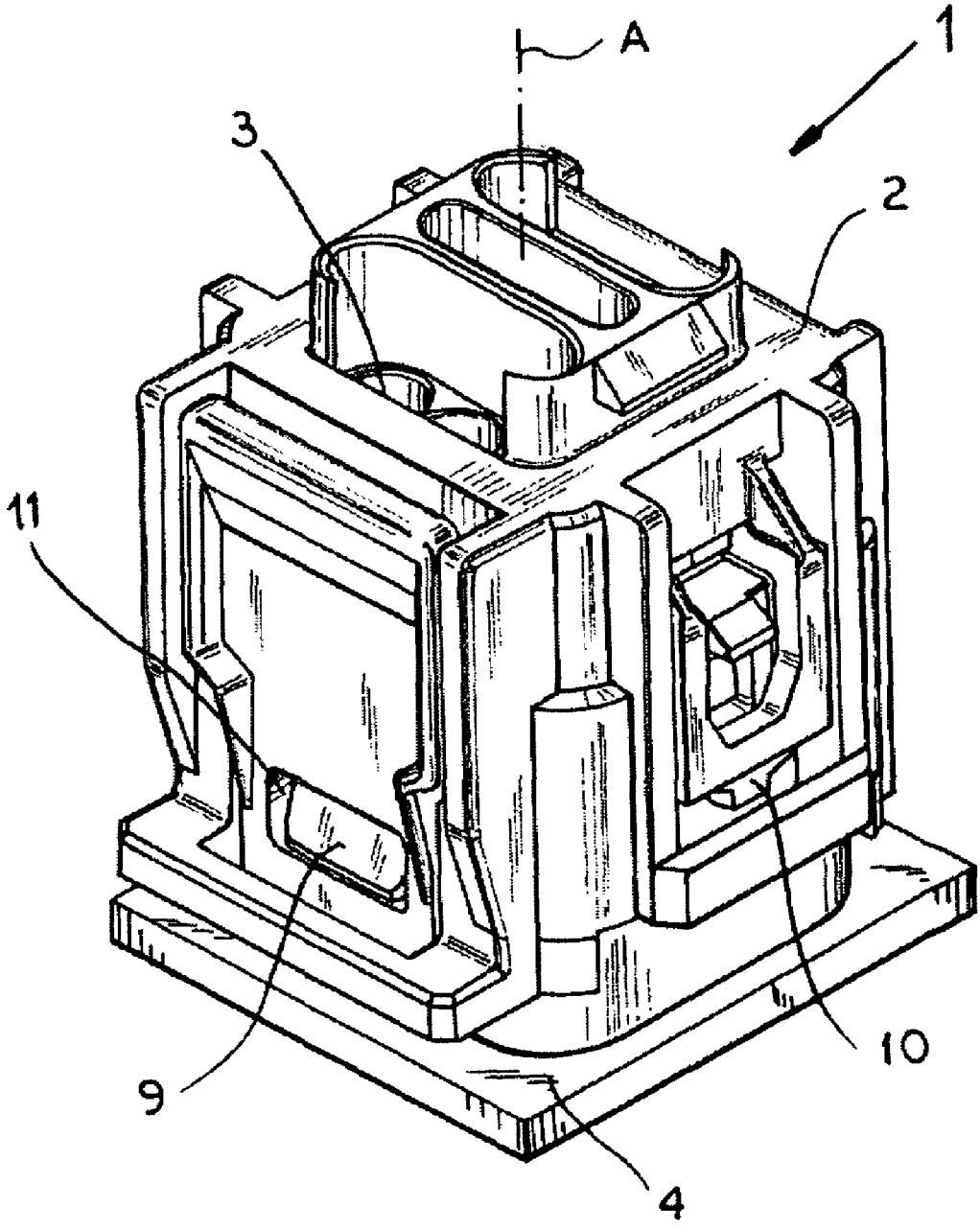
FIG. 1 is a perspective view of the connector according to the invention in a completely fitted-together position.

As seen in FIG. 1, a plug-type connector basically comprises a socket-type base 4, a contact holder 3, and a cover shell 2, all basically centered on an axis A along which the parts are fitted together.

Figure 2A:
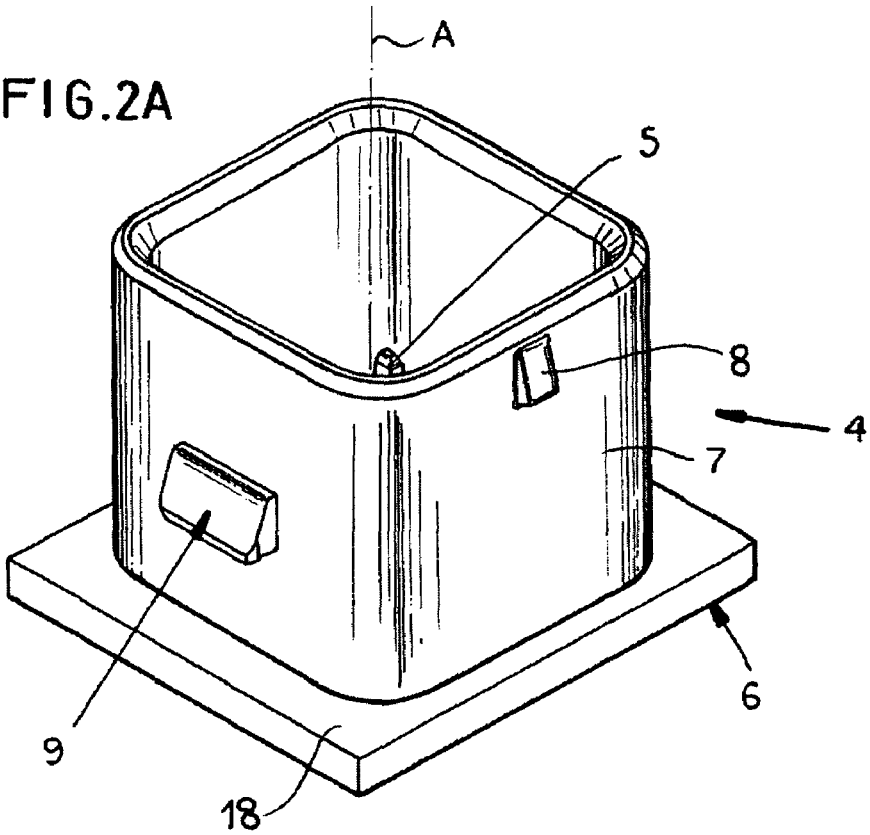
FIGS. 2A and 2*b* are perspective views of the base of the plug-type socket part.
Figure 2B:
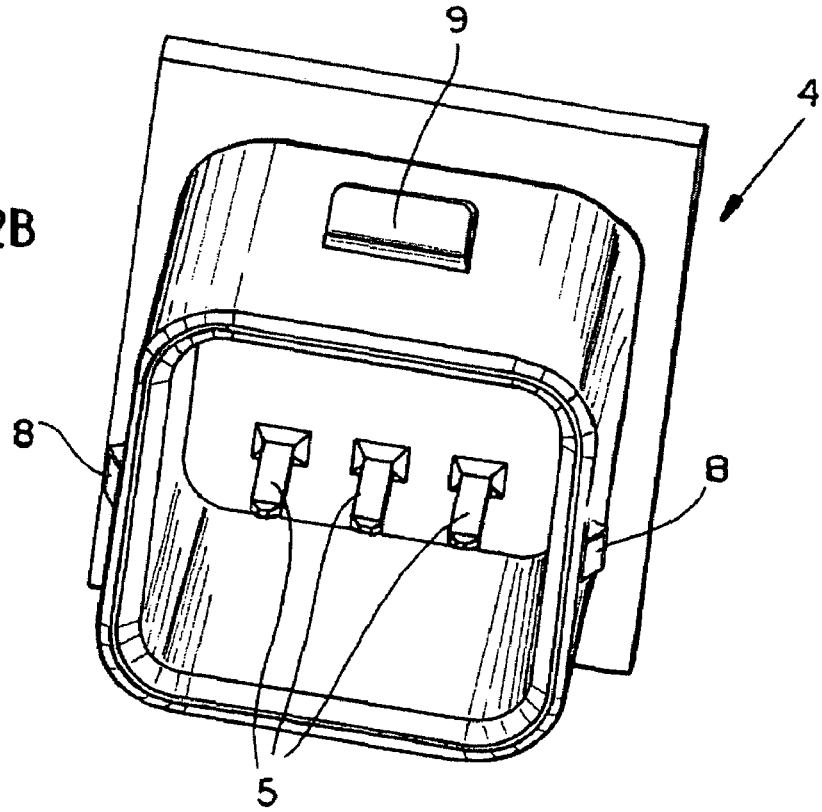

FIGS. 2A and 2B show how the socket 4 has a rectangular base plate 6 perpendicular to the axis A and a rectangular-section tubular collar 7 with rounded corners projecting upward along the axis A from the base plate 6. Rigid contact pins 5 project parallel to the axis A from the plate 6 and are recessed wholly within the collar 7. Opposite side walls of the collar 7 are provided with outer small latch formations or barbs 8 and the other opposite side walls are provided with inner larger lock formations or barbs 9. The barbs 9 are offset inward axially toward the plate 6 from the barbs 8, and all the barbs 8 and 9 are of right-triangular shape with an outwardly directed shallow flank and an inwardly directed perpendicular or steep flank. The plate 6 has an outwardly directed planar stop face 18 from which the contacts projects and that also is exposed outside the collar where the plate projects perpendicular to the axis A from the collar 7.

Figure 3A:
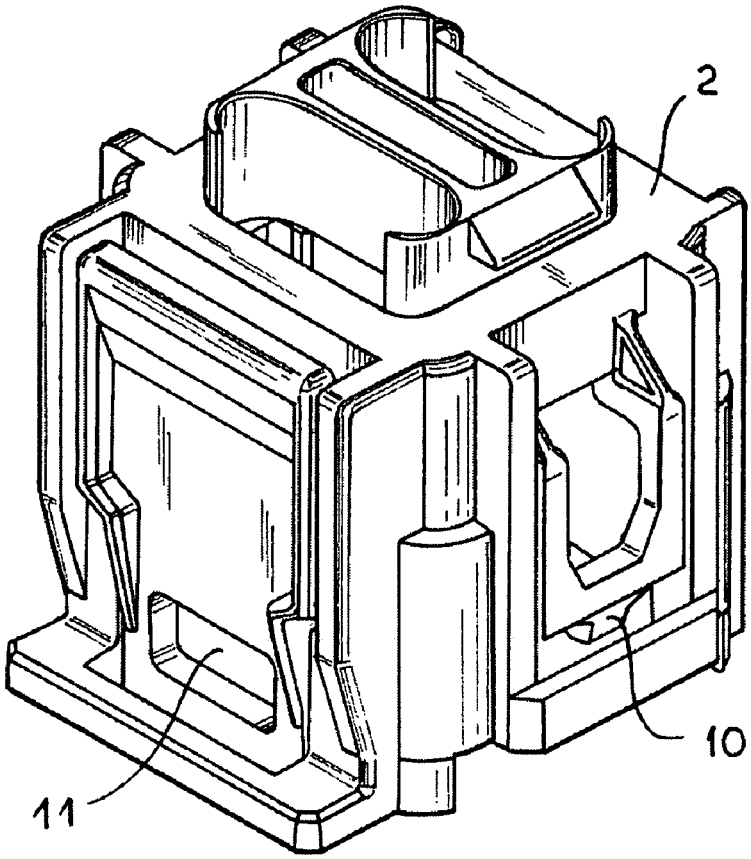
FIGS. 3A and 3B are perspective views of the fitting engageable with the structure shown in FIGS. 2*a* and 2B.
Figure 3B:
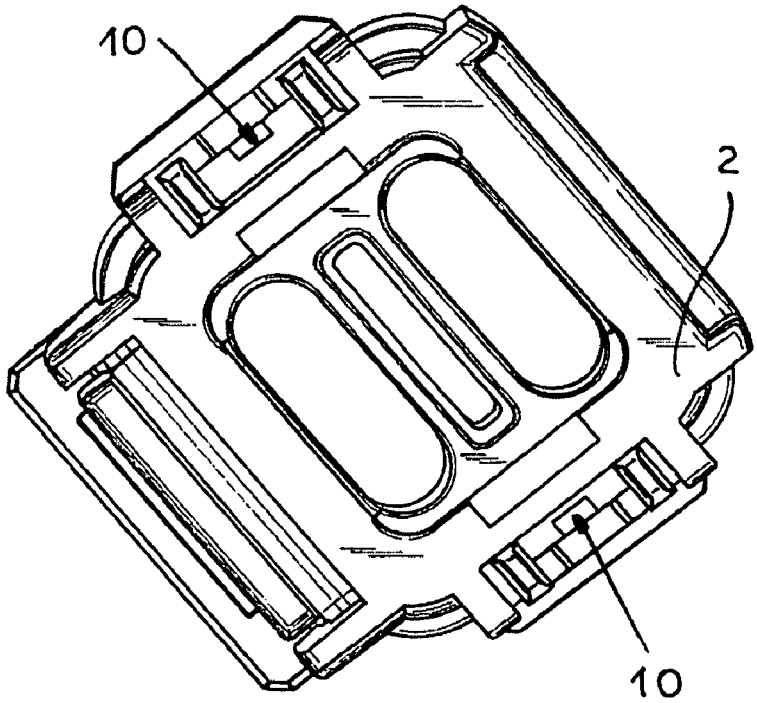

FIGS. 3A and 3B shows an embodiment of the cover shell 2 that is basically cup-shaped, with a rectangular shape substantially complementary to that of the collar 7 of the socket 4 so that it can fit fairly snugly over this socket 4. On two opposite side walls it has near its outer edge hook formations 10 that can engage the outer barb 8, and also near its outer edge it has other lock formations that here are simple apertures 11 that can receive the larger barbs 9. The formations 10 are generally level with the formations 11 so that the outer latch formations 10 can be clipped in a prelatched position described below with the barbs 9, and the formations 10 only engage the lock barbs 9 in the fully assembled or fitted-together position shown in FIG. 1.

Figure 4A:
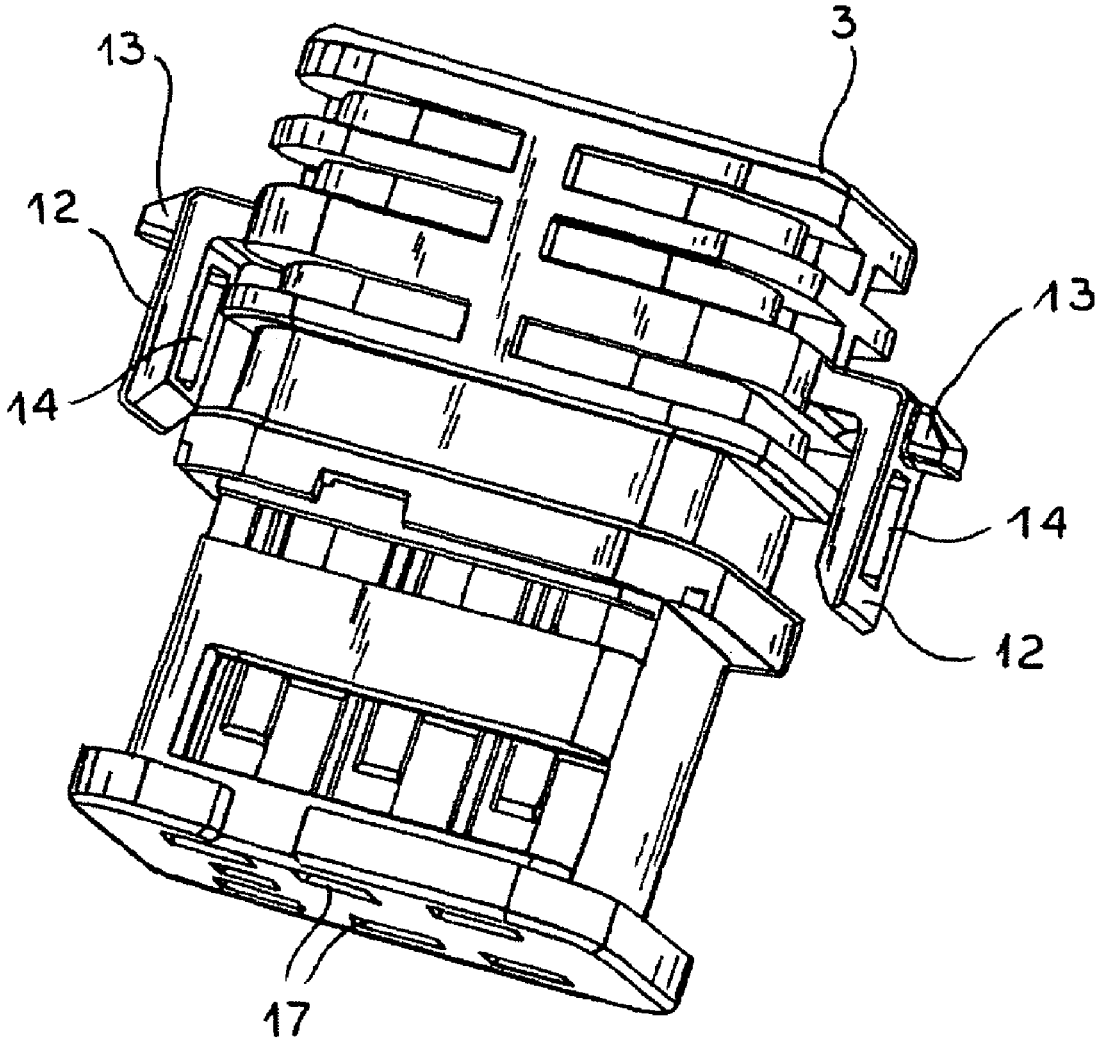
FIG. 4A is a perspective view the contact holder of this invention.

FIG. 4A shows the contact holder 3. It has a front end face 15 formed with six holes 17 into which can fit the contact pins 5 of the socket 4 for engagement with unillustrated contact sleeves inside the molded-plastic body of the holder 3. At its rear end it has holes through which cables or wires connected to these unillustrated contacts can extend. On opposite sides the square-section holder 3 has a pair of L-shaped arms 12 that are each formed with an outwardly directed barb formation 13 and with another aperture formation 14. The formation 13 can coact with the formation 10 of the shell 2.

Figure 4B:
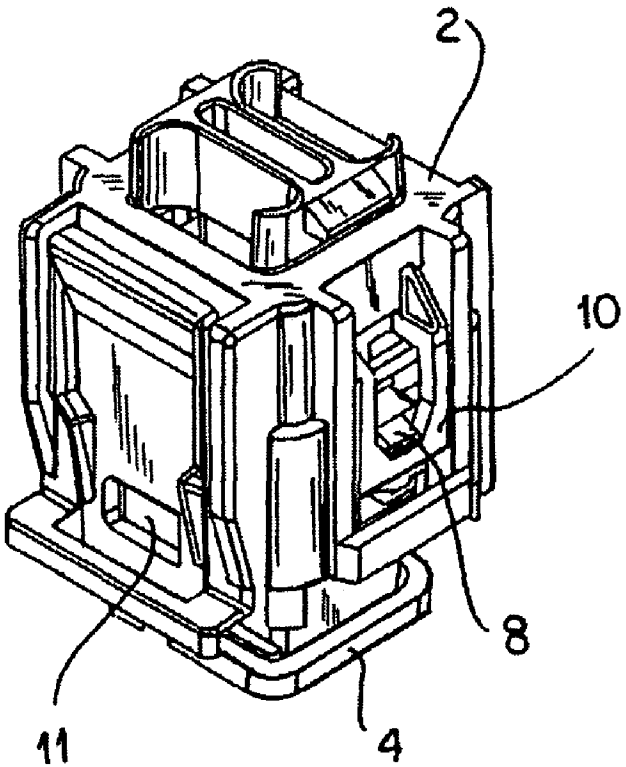
FIG. 4B is a perspective view of the cover shell in the prelatched position on the socket.
Figure 4C:
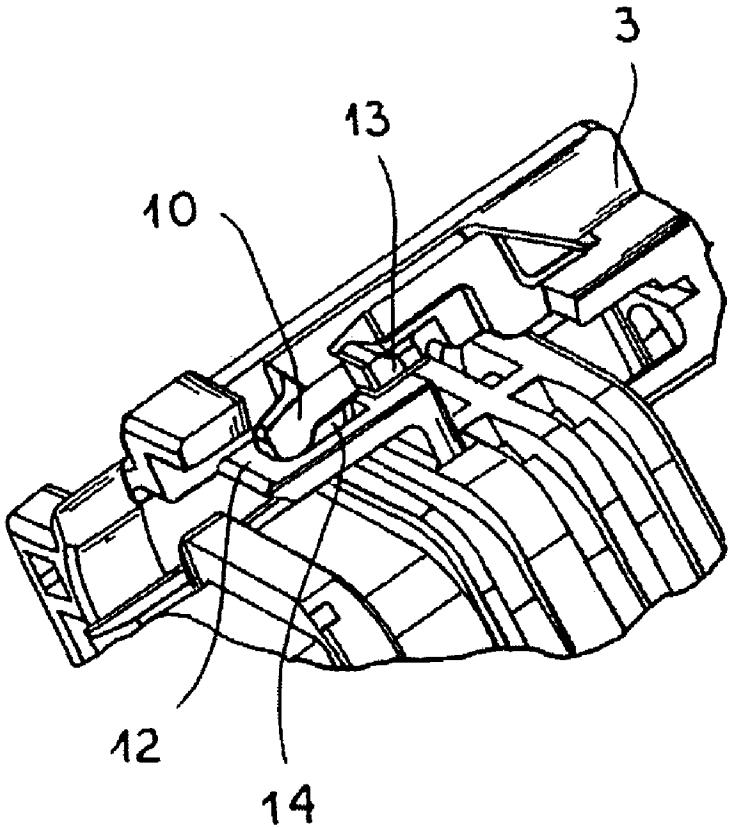
FIG. 4C is a large-scale view of a detail of FIG. 4B.
Figure 5:
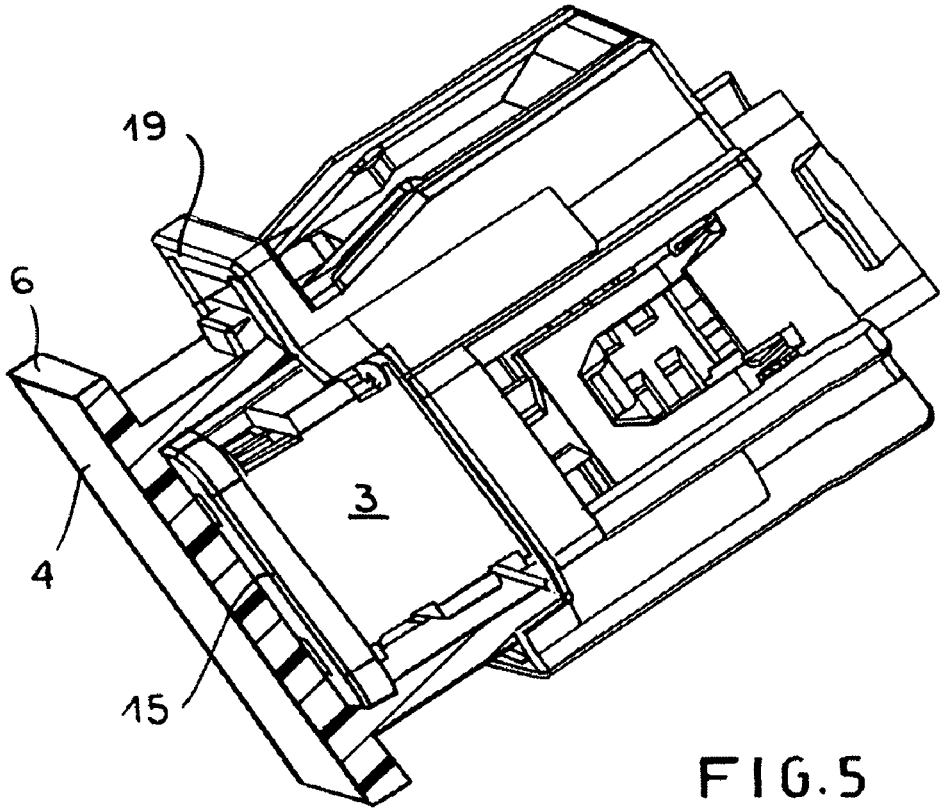
FIG. 5 is a perspective view of the connector when partly fitted together.

These latch formations 12 to 14 are symmetrically positioned on opposite sides of the contact holder 3. In addition, FIGS. 4B and 4C show the first step in the assembly, namely that the cover shell 2 and contact holder 3 are fitted together in a prelatched position in which the barbs 13 engage the top of the formations 10. In this prelatched position the contact holder 3 is not fully fitted back or outward into the cover shell 2 and as shown in FIG. 5 in fact a front face 19 of the cover shell 2 is spaced outward from a front face 15 of the holder 3. In this position the latch formation 13 is engaged such with the latch hook 10 and bracket 12 such that it is no longer possible to remove contact holder 3 from the cover shell 2 or even to move it (in particular slide it) back into its final position with the faces 15 and 19 coplanar. Thus the contact holder 3 is fixed in a defined position within cover shell 2, so that the two parts cannot move relative to each other until they are fitted as described below to the socket 4.

Figure 6:
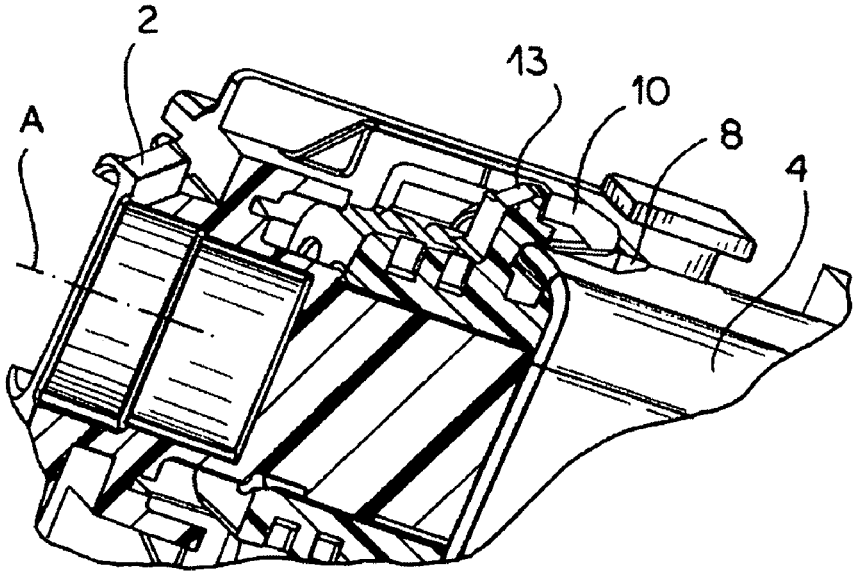
FIG. 6 is a large-scale detail of FIG. 5.
Figure 7A:
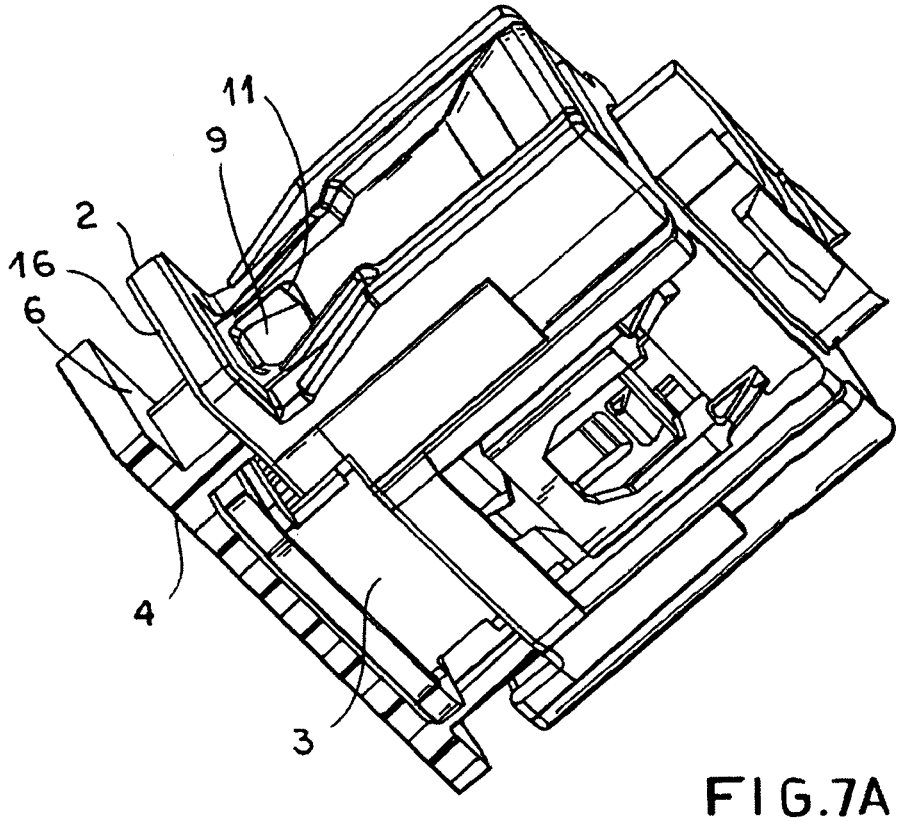
FIG. 7A is a perspective view of the connector in the fully fitted-together position.
Figure 7B:
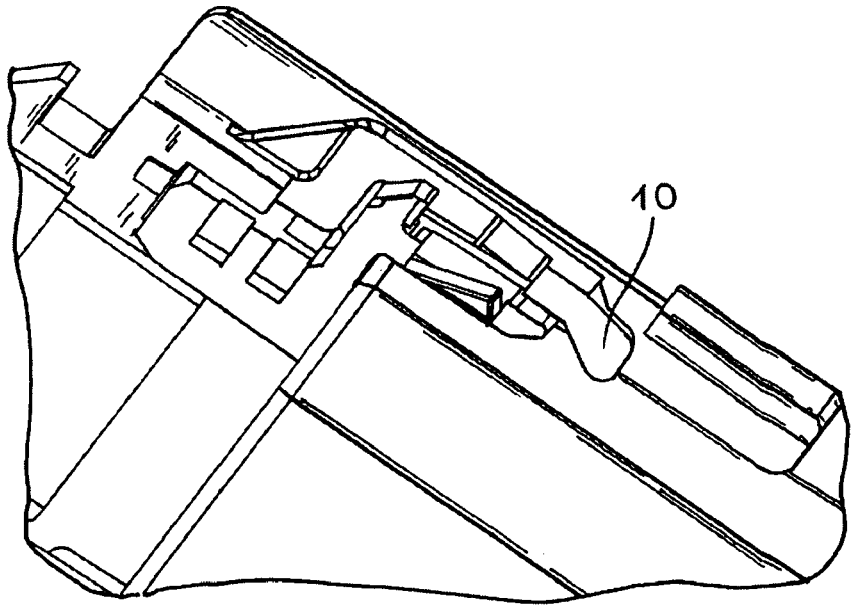
FIG. 7B is a large-scale view of a detail of FIG. 7A.

FIGS. 5 and 6 show how the contact holder 3, in the prelatched position with the cover shell, is fitted to the socket 2. The parts 3 and 4 move axially toward the part 2 until the front face 15 of the contact holder engages the face 18 of the socket 2. At this point as shown in FIG. 6, with the faces 15 and 18 abutting, the latch formations 8, 10, 12 interact so the cover shell 2 can be moved out of its prelatched position on contact holder 3 in the direction of its final latch position, that is the holder 3 slides back into the shell. After or as this is happening, the cover shell 2 slides forward so that the latch barbs 9 of the socket 4 can snap into the latch apertures 11 of the shell 11, locking everything together in the end position of FIGS. 1, 7A and 7B. In this position the front face 16 of the shell 2 bears on the face 18 of the socket 4 and the assembly is solidly latched together. Of course it is possible by depressing the formations 9 or prying out the sides of the cover 2 to disassemble the connection, but vibration and even fairly rough treatment will not uncouple the parts 2, 3, and 4.

Thus the invention provides the ability to prefabricate a plug-type connector 1, comprising a fitting itself consisting of a cover shell 2 carried on contact holder 3 in a loss-proof manner, with the contact holder 3 for its part being fitted with contacts and hookup cable. After this is done, the prefabricated fitting 2, 3 can be fitted with the socket 4 as described above.

It would also be possible to fit the parts 2, 3, 4 together when the cover shell 2 is in the final latch position, although the forces are increased thereby. In addition, the final latch position can occur only after contact holder 3 has been completely plugged together with socket 4 of the plug. In addition, the sliding of cover shell 2 from its prelatched position on contact holder 3 in the direction of its final latch position on socket 4 not only latches the plug and fitting together, but also brings to bear forces on the contacts of the fitting in particular, so that the least possible force (zero-force) is required for the plugging together. To attach optionally is not required for the function of the latching.

In a particularly advantageous manner, the drawing show that the structure of the elements of the plug-type connector 1 is approximately square or rectangular and at the same time symmetrical. It is also conceivable that the individual components of the plug-type connector 1 can have differently shaped cross-sections (e.g. oval or round). In addition, an asymmetric structure is likewise conceivable, in that the latch formations are positioned only on one side, or only at one position of the involved components of plug-type connector 1. The symmetrical structure as shown in the drawing has the advantage, however, that jamming during putting together of the involved elements is ruled out, and the latching effect, i.e. stability, is enhanced.

Finally, it should be mentioned that the latch formations that are positioned on the plug can also be positioned alternatively on the fitting, in that case with the latch formations that are positioned on the fitting being positioned alternatively on the plug. Even though the latch formations are designed in a quite complex manner to achieve the effect of the invention, it is perfectly possible to manufacture elements 2 to 4 of the plug-type connector 1, quickly and in series, out of plastic using a injection molding, while other materials and manufacturing methods are not ruled out either.

We claim:

1. A plug-type connector comprising:

a plug-type socket;

a contact holder fittable in the plug-type socket;

a cover shell engaged around the contact holder and fittable with the plug-type socket;

means including formations on the cover shell and on the contact holder for securing the holder and shell together in a prelatched position with the holder only partially fitted in the shell and for, when the holder is fitted in the socket, latching the shell to the socket and shifting the holder in the shell into a final position fully inserted in the shell.

2. The plug-type connector defined in claim 1 wherein the formations include latch formations that positively retain the cover shell in the prelatched position, the means further including release formations on the socket for decoupling the latch formations and allowing the holder to move into the end position on engagement of the prelatch formation with the release formations on fitting-together of the cover shell and socket.

3. The plug-type connector defined in claim 1 wherein the latch formations include a barb on the contact holder and a latch arm formed with a recess, the barb and latch arm being offset on an insertion direction of the holder into the cover shell.

4. The plug-type connector defined in claim 3 wherein the formations include interengaging lock formations on the cover shell and on the socket for latching together the cover shell and socket in the end position.

5. The plug-type connector defined in claim 4 wherein the locking formations include a transversely projecting barb and a transversely open window into which the barb is fittable only in the end position.

6. The plug-type connector defined in claim 5 wherein there are two such barbs and two respective windows.

7. The plug-type connector defined in claim 1 wherein the socket has a noncircular collar centered on an axis and the cover shell has a complementary noncircular collar that can telescoping interfit with the collar of the socket.

8. The plug-type connector defined in claim 7 wherein the socket has contact pins projecting parallel to the axis and recessed in the respective collar.

* * * * *

UNITED STATES PATENT AND TRADEMARK OFFICE

CERTIFICATE OF CORRECTION

PATENT NO. : 7,537,492 B2
APPLICATION NO. : 12/004089
DATED : May 26, 2009
INVENTOR(S) : Rudolf Fekonia et al.

It is certified that error appears in the above-identified patent and that said Letters Patent is hereby corrected as shown below:

On the Title Pg. Item (75), the city address of the second inventor, Arnold Federer, is -- Götzis, AT --

On the Title Pg. Item (75), the city address of the third inventor, Kurt Ellensohn, is -- Götzis, AT --

On the Title Pg. Item (73), there are two (2) Assignees; they should be shown as follows:

-- Assignees: Hirschmann Automotive GmbH,
Rankweil-Brederis (AT)
And
Bayerische Motoren Werke AG
Munchen (DE) --

Signed and Sealed this

Twenty-second Day of December, 2009

David J. Kappos

David J. Kappos
*Director of the United States Patent and Trademark Office*